US005522192A

United States Patent [19]

Frantl et al.

[11] Patent Number: 5,522,192

[45] Date of Patent: Jun. 4, 1996

[54] HANGAR

[76] Inventors: Erich Frantl, Laudongasse 33/76, A-1080 Vienna; Werner Frantl, Tagliebergasse 6/17/13, A1230 Vienna, both of Austria

[21] Appl. No.: 291,537

[22] Filed: Aug. 16, 1994

[30] Foreign Application Priority Data

Aug. 16, 1993 [AT] Austria ..... 1629/93
Dec. 21, 1993 [AT] Austria ..... 2583/93

[51] Int. Cl.[6] ..... E06B 1/04

[52] U.S. Cl. ..... 52/206; 52/64; 244/114 R

[58] Field of Search ..... 52/64, 69, 70, 52/236.1, 65, 207, 206, 645, 646; 49/116, 123, 360, 410, 411, 125, 127, 366; 244/114 R

[56] References Cited

U.S. PATENT DOCUMENTS 1,462,302 7/1923 Phillips ..... 49/127
2,320,604 6/1943 Jackson et al. .
3,169,574 2/1965 Behlen .
3,389,514 6/1968 Horvath .
3,739,537 6/1973 Barnes .
4,144,685 3/1979 Fox .

FOREIGN PATENT DOCUMENTS 2289687 6/1978 France .
2307924 1/1981 France .
9100963.4 3/1992 Germany .

*Primary Examiner*—Kien T. Nguyen
*Attorney, Agent, or Firm*—Young & Thompson

[57] ABSTRACT

A gate girder (5)is provided over the gateway opening of a hangar. To diminish the roof load and working load stressing the gate girder (5), it is supported by at least one girder support (1), which can be combined with a sliding gate plate (1'). On the lower and upper edges of girder support (1), rollers (9, 10) are provided, which are at equal distances from one another. To assure a uniform stress both of the upper support of gate girder (5) and of lower footing (6), in each case pairs of upper rollers (9) are mounted by levers (7) on supports (16), which are guided vertically movable in sliding gate panel (1'). In addition, a freely rotatable roller (15)is mounted on each support (16). A steel cable (18) wound around rollers (15), is placed over each roller (15), which in addition is guided by deflecting rollers (14) mounted freely rotatable on girder support (1), and is fixed with its ends (19) to the girder support (1). Thus, only forces of equal size can be accommodated by upper rollers (9), which are passed on by lower rollers (10), which are mounted by levers (7') on push rods (20), which are fastened to girder support (1), uniformly and only of equal size to footing (6).

22 Claims, 4 Drawing Sheets

HANGAR

Figure 1:
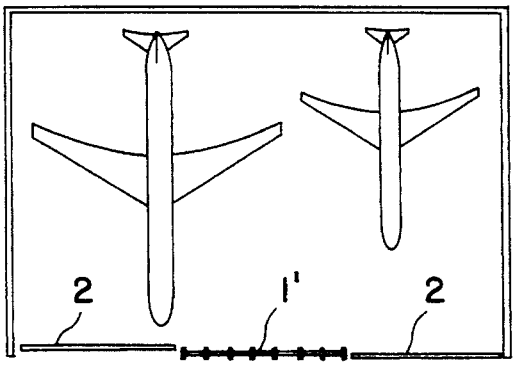

The invention relates to a hangar with a gateway opening, over which a gate girder, lying on its ends on the end supports of the hangar, is provided, and with a footing, especially a continuous footing, on the lower edge of the gateway opening.

With the new design of hangar installations for parking and maintaining commercial aircraft, hangars for the simultaneous parking of two or more aircraft are preferred, in which hangar widths of 130 to 160 m with hangar depths of 65 to 90 m are constructed because of the wing, spreads of average to large aircraft.

Because of the large wing spreads, these hangar widths require very heavy and high gate girders, since the latter must carry, in most cases, a good part of the roof load and all working loads of wind, snow, gantry crane load, etc., over the large wing span to the end supports of the hangar.

These gate girders are not only very expensive, but by their height, they also impede the view of the air traffic controllers, are strong radar reflectors and because of the great height of the building in comparison to the required height of interior space, also necessitate greater safe distances to the runways.

Rigid intermediate supports (girder supports) of the gate Birders are unusual because of the lesser flexibility when parking and switching around aircraft of different size.

The object of the invention is to provide, along the plane of the gate, and preferably integrated in individual gate plates, many girder supports of the gate girder movable with one another, which by their structural design assure a uniform load both of the Bate girder and of the continuous footing.

To solve this problem, the invention provides that the gate girder be supported by at least one girder support to the footing guided movably over rollers on the gate girder and on the footing.

The free span of the gate girder, necessary for the gateway of aircraft, between the intermediate supports (girder supports) is reduced by the invention to about one third to two thirds of the total length of the gate girder, and at significantly lower costs and dimensions of the gate girder, freely selectable gateway openings for different parking variants of aircraft in the hangar result.

The solution of the problem, to divide, especially uniformly, the gate girder support load into several movable supports and their support wheels (rollers on the girder supports), can be achieved both with mechanical and with hydraulic structural means and with a combination of both possibilities.

In an especially simple and economical embodiment of the invention, it is provided that the girder support be integrated in a gate plate movable to open or close the gateway opening. Separate girder supports, i.e., separated from the gate plate or the gate plates, are unnecessary in this embodiment of the invention.

A sturdy design results if, according to a proposal of the invention, it is provided that the rollers are mounted freely rotatable on levers on the upper edge of the girder support, oil the one hand, and the rollers on the lower edge of the girder support, on the other hand, and that the levers are mounted to swivel on the girder support. Thus, the forces introduced by the gate girder into the girder support can be distributed to the rollers in a simple way and effectively. In this case, it is preferred according to the invention if the levers are equal-armed levers.

In particular, in the case of larger dimensions of the hangar and in the case of several rollers on the girder support, an embodiment of the invention, which is characterized in that the levers carrying rollers on their part can be mounted to swivel on the ends of additional levers mounted to swivel in tile girder support, has proven itself. The advantageous effect of this embodiment can also be increased if the additional levers at the ends of another lever mounted to swivel in the girder support are mounted to swivel.

It is advantageous in the invention if the levers, which support the levers, which carry the rollers, are coupled on the upper edge of the girder support by a lever, which is mounted to swivel on a support element, and that the additional levers on the lower edge of the girder support are mounted to swivel at points of the support element placed at a distance from one another. In this way, the rollers provided on the upper edge and on the lower edge of the girder support can be coupled with one another simply and reliably, without the object sought with the invention being adversely affected.

Instead of a mechanical achievement of the object on which the invention is based, it can also be provided that the rollers on the upper edge of the girder support are connected with one another by supports with the rollers on the lower edge of the girder support, and that piston-cylinder arrangements that are, hydraulically connected with one another in the supports are provided. This embodiment has the advantage that the maintenance expenditure is small, since no mechanical components have to be maintained. In the hydraulic achievement, it can also be provided that the rollers on the upper edge of the girder support are connected by equal-armed levers, which are mounted to swivel on the supports. In addition, it can be provided that the rollers on the lower edge of the girder supports are connected by equal-armed levers with the supports.

An advantageous embodiment is produced if the levers carrying the rollers provided on the upper edge of the girder support and the levers carrying the rollers provided on the lower edge of the girder support are connected to swivel with the supports, since possible unevennesses in the gate girder and in the continuous footing thus can be compensated for.

For reasons of symmetry, it is preferred within the scope of the invention if in each case an even number of rollers is provided on the upper edge of the girder support and on the lower edge of the girder support.

The uniform distribution of the forces on the rollers is improved if the rollers on the upper edge of the girder support are at distances of equal size from one another. With the same advantageous effect, the rollers on the lower edge of the girder support can also be at distances of equal size from one another.

In a preferred embodiment of the hangar according to the invention, the latter is distinguished in that the rollers are arranged on the upper edge of the girder support or the levers carrying them are arranged on push rods, which are guided vertically movable on the girder support, and in that the push rods are coupled with one another by a flexible torsion member. In this way, the forces introduced in the girder support by the gate girder are distributed by simple mechanical means to the rollers provided on the upper and on the lower edge of the girder support, which, for example, is a gate girder.

In a structurally simple embodiment, it can be provided that the flexible tension member on the push rods winds around rollers, mounted freely rotatable, from below.

The tension, necessary for the operation of this embodiment, in the tension member, which can be a cable or a chain, is achieved in a simple way, in that the tension member with its ends is fastened to the girder support according to a proposal of the invention.

The tension member provided in this embodiment can be guided to the girder support in a different manner. In the invention, it is preferred that the tension member be guided by deflecting rollers rotatably mounted on the girder support on both sides of the push rods. In this case, it is preferred that the deflecting rollers on the girder support are arranged higher than the rollers on the push rods. To assure an exact guiding of the push rods on the girder support, it is provided according to a proposal of the invention that the push rods are guided movably in which are provided on the girder support.

The embodiment of the hangar according to the invention with a tension member can also be distinguished in that the flexible tension member is prestressed by a prestressing means acting on the push rods. In particular, when it is provided that the prestressing means is a flexible tension element, which acts on the push rods by the rollers mounted on the latter, the tension member is prestressed and thus a part of its elasticity is reduced by the prestressing means. If the forces having an effect on the Birder support are increased, the tension member expands less. Simultaneously, the tension element of the prestressing means is at times relieved.

In a preferred embodiment of the invention, it can be provided here that the tension element winds around the rollers from above.

To simplify the guiding of the tension element being used as a prestressing means for the tension member, the invention proposes in an embodiment that the tension element be guided by deflecting rollers mounted rotatably on the girder support on both sides of the push rods. Here, it can be provided that the deflecting rollers are arranged lower on the girder support than the rollers on the push rods.

Because of simple design, it is preferred within the scope of the invention that the tension element be fastened to the girder support with its ends.

Figure 2:
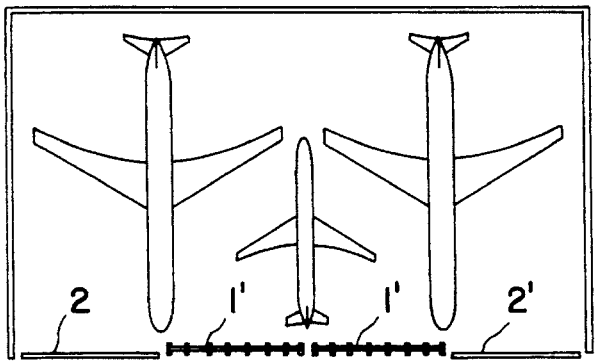
Figure 3:
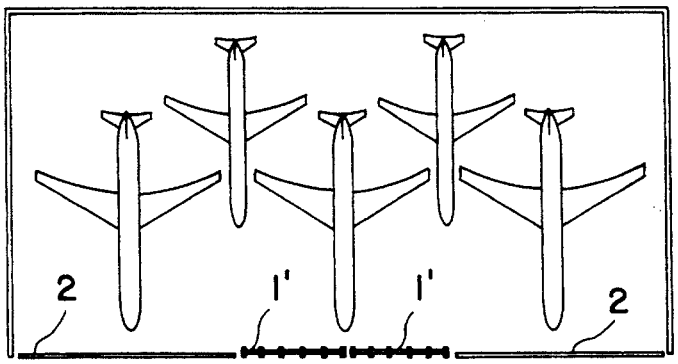
Figure 4:
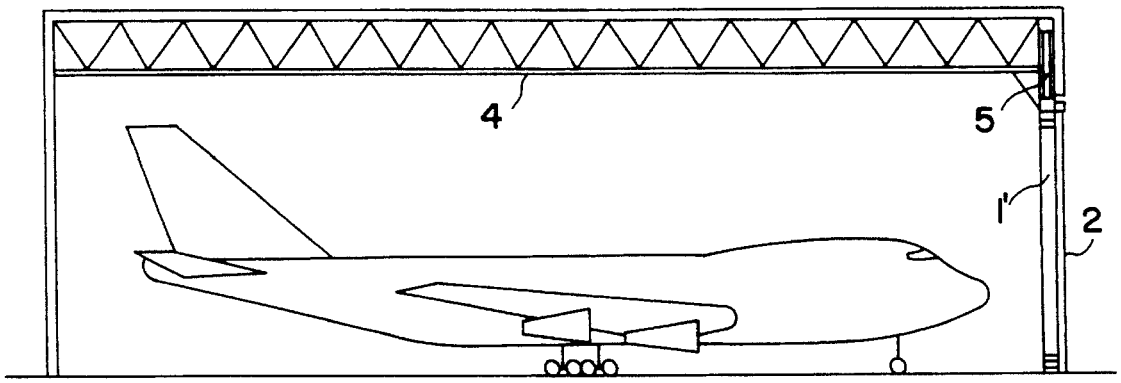
Figure 5:
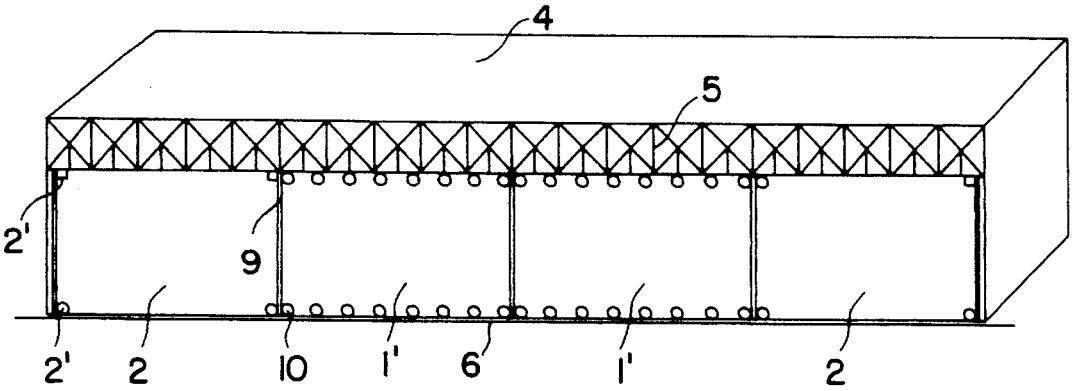
Figure 6:
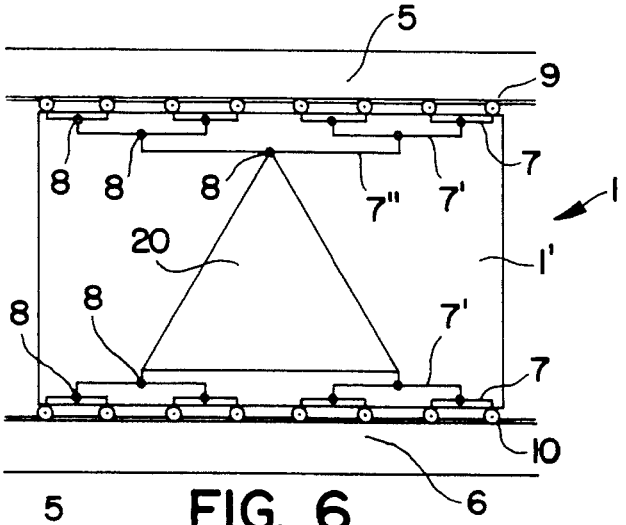
Figure 7:
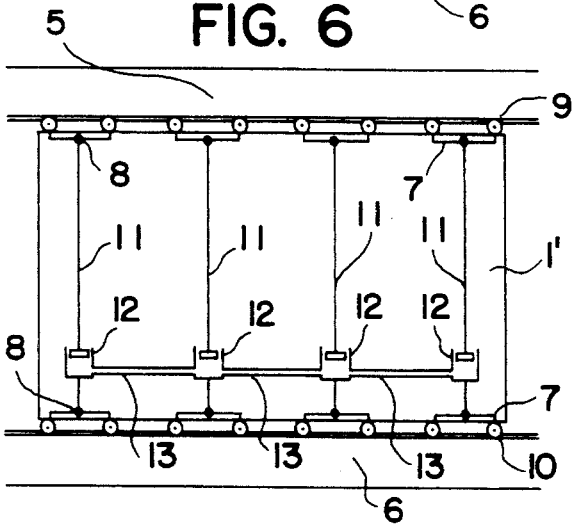
Figure 8:
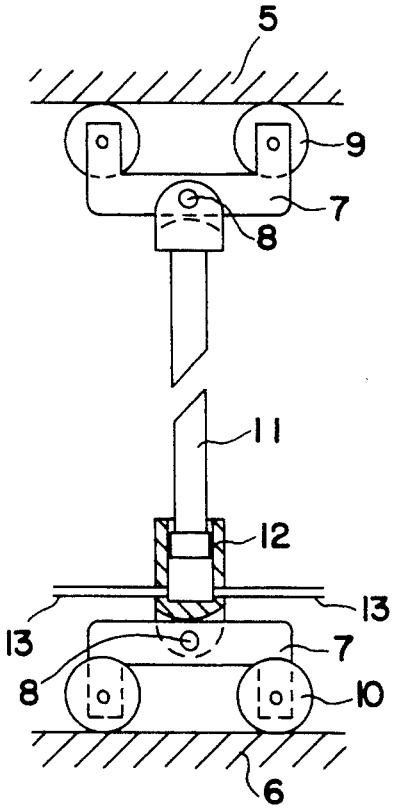
Figure 9:
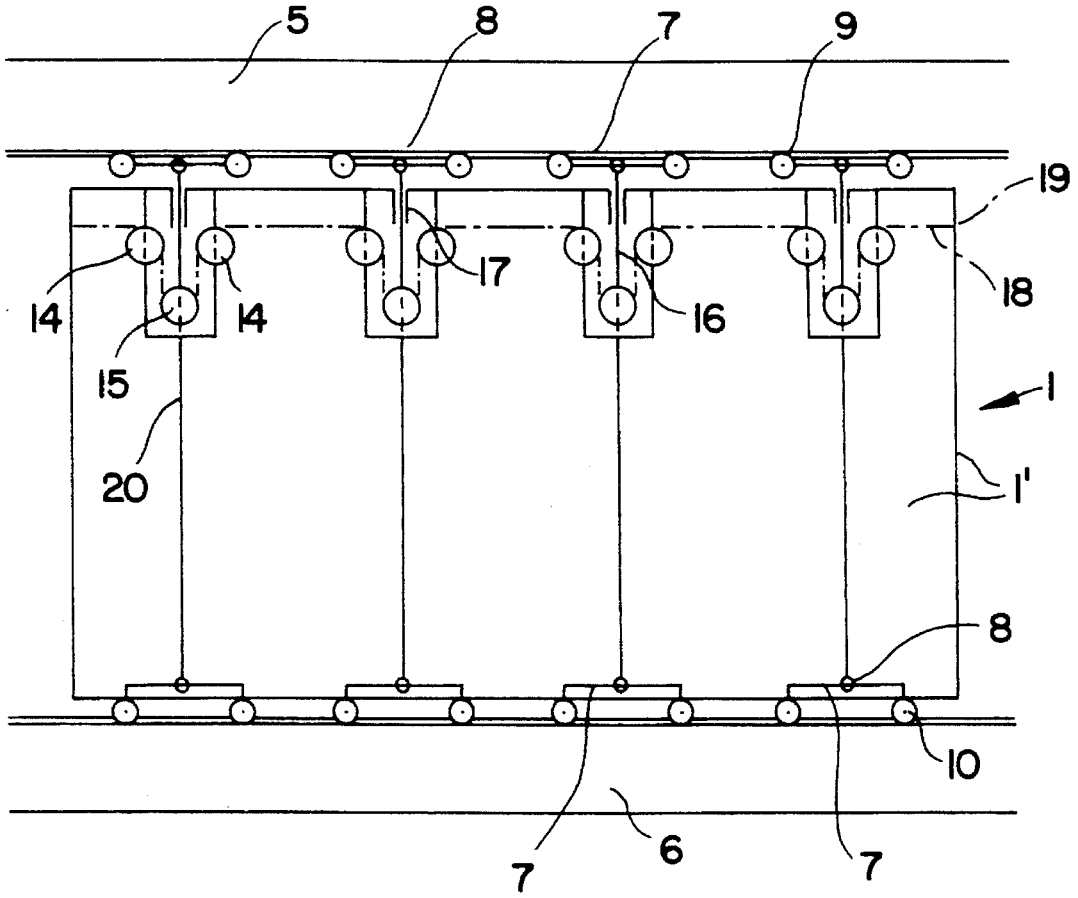

The invention is explained below in more detail based on embodiments with reference to the drawings, in which the invention is shown. There are shown:

FIG. 1 to 3 in top view, variants of aircraft hangars,

FIG. 4 an aircraft hangar in cross section,

FIG. 5 an aircraft hangar with two supporting gate plates in oblique view,

FIG. 6 an embodiment of a supporting gate plate,

FIG. 7 another embodiment of a supporting gate plate,

FIG. 8 a detail of FIG. 7,

FIG. 9 another embodiment of a supporting gate plate and

Figure 10:
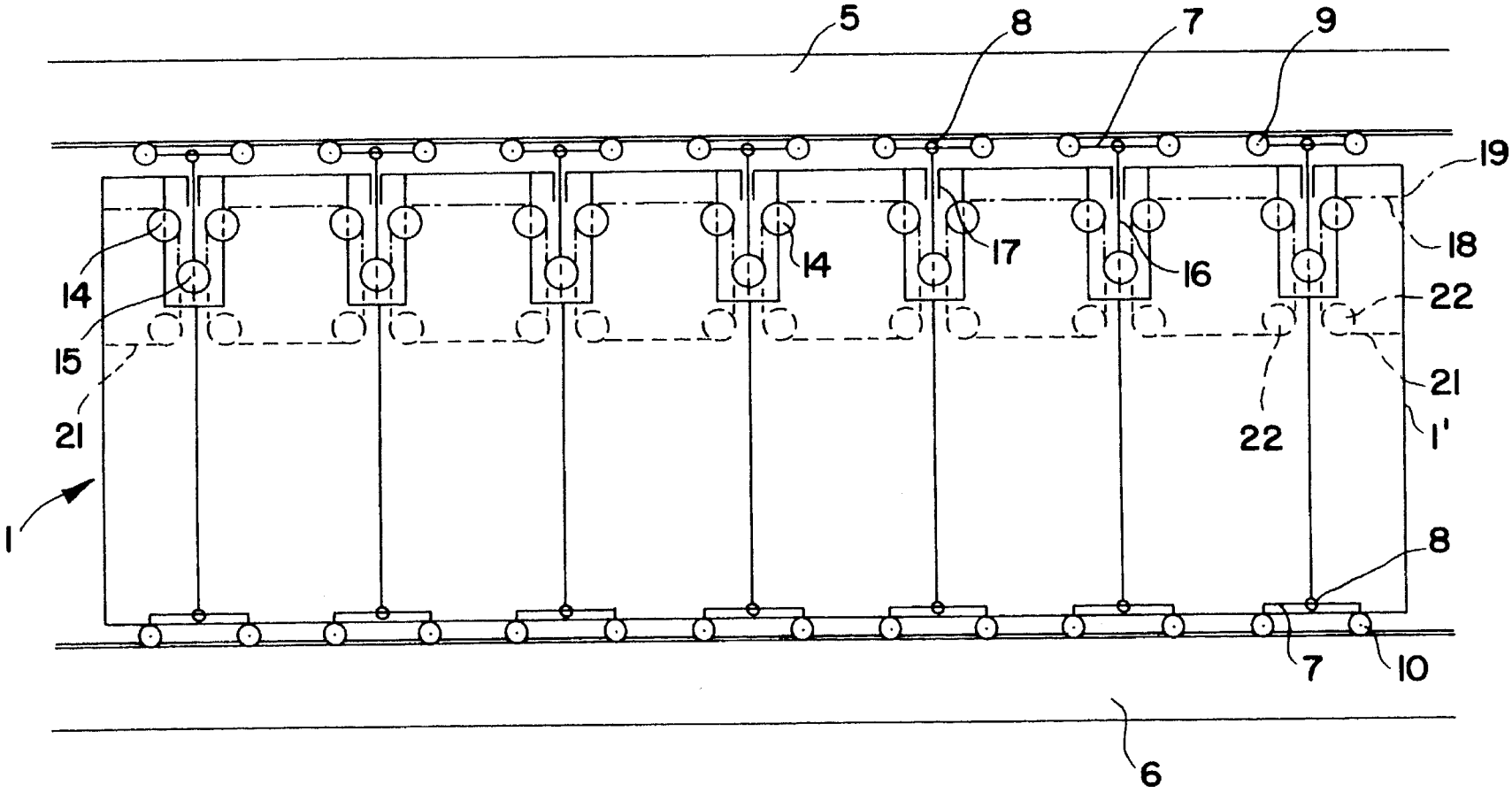

FIG. 10 an embodiment further developed relative to FIG. 9.

FIG. 1, 2 and 3 show in outline different sizes of hangars and parking configurations, which are now usual, and one or two supporting gate plates 1' and two nonsupporting gate plates 2 are provided in the gateway opening of the hangar.

FIG. 4 shows a hangar in cross section with a roof structure 4, which is placed over the gateway opening on a front gate girder 5, which for its part rests again with its ends on the end supports of the hangar and is also carried by supporting gate plates 1'.

FIG. 5 shows as example the hangar represented in FIG. 2 in a diagrammatical perspective with roof 4, gate girder 5, continuous footing 6 along the gateway opening, supporting gate plates 1' and nonsupporting gate plates 2. FIG. 5 also shows that nonsupporting gate plates 2 are guided movably over two upper and two lower rollers 2' each on gate girder 5 and on continuous footing 6. However, several (eight in the embodiment)rollers 9 are provided on the upper edge of gate plates 1' and also several rollers 10 are provided on the lower edge of gate plates 1' . Rollers 9 or 10 are at identical distances from one another. In addition, one upper roller 9 each lies vertically over a lower roller 10.

FIG. 6 shows the mechanical achievement of the load distribution of gate girder 5 to continuous footing 6 by levers 7, 7' and 7", which accommodate the support pressures of upper rollers 9, coupled by hinges 8, only of the same size and pass them on to lower rollers 10 of the same size. In addition, the support pressures of lower rollers 10 are uniformly distributed, i.e., are passed on in partial loads that are equal in size to continuous footing 6.

Specifically, in the case of the "mechanical" solution shown in FIG. 6, a series of four equally long, first levers 7, on whose ends rollers 9 are mounted freely rotatable, is provided. Each of first levers 7 is supported by a hinge 8 on its center at the ends of a second lever 7' (altogether two second levers 7' are provided). Second levers 7' are supported by hinges 8 on a third lever 7", which is mounted to swivel by a hinge 8 on a support element 20. Triangular support element 20 in the embodiment shown has hinges 8 on the two ends of its base for second lever 7' on the lower end of girder support 1 formed by gate plate 1', on whose ends respectively two first levers 7 are mounted to swivel by hinges 8, in which lower rollers 10 are mounted freely rotatable on the ends of first levers 7.

FIG. 7 shows the hydraulic achievement of the object on which the invention is based, in which the support forces of upper rollers 9, mounted paired on levers 7, are guided by pistons in oil-filled cylinder 12 provided on the lower end of supports 11, which are connected communicating with one another by lines 13, so that only forces equal in size are accommodated and rollers 10, lying below cylinders 12 and connected with the latter by levers 7, can be provided uniform in size to continuous footing 6.

FIG. 8 represents one of hydraulic supports 11 in detail. It can be seen that upper rollers 9 are mounted freely rotatable on a lever 7 and run on the underside of gate girder 5, e.g., on a track provided there or in a groove provided there. Four upper levers 7 are all equal in length and arranged so that in each case a distance equal in size exists between upper and lower rollers 9 and 10 as in FIG. 6. Levers 7 are connected by hinges 8 with supports 11, on whose free ends the pistons are provided, which are accommodated sliding in cylinders 12 in the area of the lower sections of supports 11. Cylinders 12 carry levers 7, on whose free ends lower rollers 10 are mounted freely rotatable, by hinges 8. Lower rollers 10 run on a footing 6, e.g., continuous footing 6, provided below gate girder 5, or on a guide rail provided on or in the latter. Thus, as in the embodiment shown in FIG. 6, all upper rollers 9 are at identical distances from one another, which also applies to lower rollers 10. Moreover, an upper roller 9 is arranged over each lower roller 10.

In the embodiment shown in FIG. 9, several—four in the embodiment shown—push rods 16 are mounted movably vertical in guideways 17 on gate plate 1' used as girder support 1. Push rods 16 carry levers 7 on their upper ends by hinges 8, levers on which upper rollers 9 are mounted. On the lower ends of push rods 20 connected with gate plate 1 used as girder support 1 and oriented aligned with push rods 16, levers 7 are mounted by hinges 8, which carry lower rollers 10, mounted freely rotatable, on their ends. Upper rollers 9 run on the underside of upper gate girder 5, e.g., on a track provided there or in a groove provided there. Lower rollers 10 run on the surface of continuous footing 6 pointing upward, e.g., on a track.

A roller 15 is mounted freely rotatable on each push rod 16, roller whose axis of rotation is aligned essentially horizontal and perpendicular to gate plate 1'. Deflecting rollers 14 are mounted freely rotatable on both sides of each push rod 16 on gate plate 1' above rollers 15. As shown in FIG. 9, a flexible tension element 18, for example, a steel cable or a chain, is placed over rollers 14 and wound from below around each of rollers 15 on push rods 16. Both ends 19 of flexible, but practically not tensile-elastic tension member 18 are fastened to sliding gate panel 1. Preferably, a multistrand steel cable is used as flexible tension element 18.

It should also be pointed out that guideways 17 for push rods 16 are fastened vertically oriented in the area of the upper edge of sliding gate plate 1', thus of girder support 1.

By the arrangement of push rods 16 coupled with one another by tension member 18, the above-described uniform distribution of the load to all rollers 9 and 10 is achieved.

in FIG. 10, an embodiment corresponding in principle to the embodiment shown in FIG. 9 and described based on this figure is shown, in which a prestress for flexible tension member 18 is provided. The prestress is achieved by a tension element 21 fastened with its two ends in gate plate 1', which is used as prestressing means. Tension element 21 can be a steel cable, similar to tension member 18, preferably a multistrand steel cable, or a chain.

Tension element 21 is guided by deflecting rollers 22 mounted freely rotatable on girder support 1—gate plate 1' in the shown embodiment—and winds around each of rollers 15, mounted freely rotatable on push rods 16, from above. In this case, it is preferred that rollers 15 have two peripheral grooves, namely one for tension member 18 and one for tension element 21, or simply two, for example, on opposite sides of push rods 16, rollers 15 mounted freely rotatable, which can be arranged coaxially to one another, are provided. By the arrangement of tension element 21 used as prestressing means, tension member 18, which produces the uniform load distribution (automatically) is prestressed and expands less, if forces from gate girder 5 are introduced in girder support 1 (e.g., gate plate 1') by upper rollers 9, levers 8 and push rods 16, than if it were not prestressed.

In summary, the invention can be represented as follows:

A gate girder 5 is provided over the gateway opening of a hangar. To diminish the roof load and working load stressing gate girder 5, gate girder 5 is supported by at least one girder support 1, which can be combined with a sliding gate plate 1'. On the lower and upper edges of girder support 1, rollers 9, 10 are provided, which are at distances of equal size from one another. To assure a uniform stress both of the upper support of gate girder 5 and of lower footing 6, in each case pairs of upper rollers 9 are mounted by levers 7 on supports 16, which are guided vertically movable in sliding gate panel 1'. In addition, a freely rotatable roller 15 is mounted on each support 16. A steel cable 18 winding around rollers 15, in each case below, is placed over each roller 15, which in addition is guided by deflecting rollers 14 mounted freely rotatable on girder support 1 and fixed with its ends 19 to girder support 1. Thus, only forces equal in size can be accommodated by upper rollers 9, which are provided by lower rollers 10, which are mounted by levers 7' on push rods 20, which are fastened to girder support 1, uniformly and only equal in size to footing 6.

What is claimed is:

1. A hangar having a gateway opening, a gate girder (5) lying on its ends on end supports of the hangar and overlying the gateway opening, and a footing (6) on the lower edge of the gateway opening, the gate girder (5) being supported by at least one girder support (1) on said footing (6), said girder support (1) being guided movably on rollers (9, 10) on said gate girder (5) and on said footing (6), said girder support (1) being integrated in a gate plate (1') movable for opening and closing the gateway opening.

2. A hangar according to claim 1, wherein said rollers (9, 10) are mounted on the upper edge of said girder support (1) and on the lower edge of the girder support (1) so that the forces exerted by the gate girder (5) on the girder support (1) are distributed among said rollers (9, 10).

3. A hangar according to claim 2, wherein said rollers (9, 10) are so mounted that said forces are distributed uniformly on said rollers (9, 10).

4. A hanger according to claim 1, wherein said rollers (9, 10) are mounted freely rotatably on levers (7), and wherein said levers (7) are mounted to swivel on said girder support (1).

5. A hangar according to claim 4, wherein said levers (7) are equal-armed levers.

6. A hangar according to claim 1, wherein on the upper edge of said girder support (1) and on the lower edge of said girder support (1), in each case an even number of rollers (9, 10) is provided.

7. A hangar according to claim 1, wherein said rollers (9) on the upper edge of said girder support (1) are at distances of equal size from one another.

8. A hangar according to claim 1, wherein said rollers (10) on the lower end of said girder support (1) are at distances of equal size from one another.

9. A hangar having a gateway opening, a gate girder (5) lying on its ends on end supports of the hangar and overlying the gateway opening, and a footing (6) on the lower edge of the gateway opening, the gate girder (5) being supported by at least one girder support (1) on said footing (6), said girder support (1) being guided movably on rollers (9, 10) on said gate girder (5) and on said footing (6), said rollers (9) being arranged on the upper edge of said girder support (1) carrying said rollers (9) on push rods (16), which are guided vertically movably on said girder support (1), and wherein said push rods (16) are coupled with one another by a flexible tension member (18).

10. A hangar according to claim 9, wherein said flexible tension member (18) on said push rods (16) winds around rollers (15), mounted freely rotatable, from below.

11. A hangar according to claim 9, wherein said tension member (18) is fastened with its ends (19) to said girder support (1).

12. A hangar according to claim 9, wherein said tension member (18) is guided by deflecting rollers (14), mounted rotatable on girder support (1), on both sides of said push rods (16).

13. A hangar according to claim 12, wherein said deflecting rollers (14) are arranged higher on said girder support (1) than said rollers (15) on said push rods (16).

14. A hangar according to claim 9, wherein said push rods (16) are guided movably in guideways (17), which are provided on said girder support (1).

15. A hangar according to claim 9, wherein said flexible tension member (18) is prestressed.

16. A hangar according to claim 9, wherein said flexible tension member (18) is prestressed by a prestressing means (21) acting on said push rods (16).

17. A hangar according to claim 16, wherein the prestressing means is flexible tension element (21), which acts on push rods (16) by rollers (15) mounted on the latter.

18. A hangar according to claim 17, wherein said tension element (21) winds around said last mentioned rollers (15) from above.

19. A hangar according to claim 17, wherein said tension element (21) is guided by deflecting rollers (22) mounted rotatably on said girder support (1) around both sides of said push rods (16).

20. A hangar according to claim 19, wherein said deflecting rollers (22) on said girder support (1) are arranged lower than said rollers (15) on said push rods 16).

21. A hangar according to claim 17, wherein said flexible tension element (21) is fastened with its ends to girder support (1).

22. A hangar according to claim 9, wherein said rollers (10) on said footing (6) are mounted on said levers (7), which are mounted to swivel on push rods (20) connected with said girder support (1) by hinges (8).

* * * * *